US005727400A

United States Patent [19]

Lonati et al.

[11] Patent Number: 5,727,400

[45] Date of Patent: Mar. 17, 1998

[54] METHOD FOR MANUFACTURING SOCKS HAVING A CLOSED TOE WITH A SINGLE-CYLINDER KNITTING MACHINE

[75] Inventors: Francesco Lonati; Ettore Lonati; Fausto Lonati; Tiberio Lonati, all of Brescia, Italy

[73] Assignee: Matec S.r.l., Scandicci, Italy

[21] Appl. No.: 675,206

[22] Filed: Jul. 8, 1996

[30] Foreign Application Priority Data

Jul. 28, 1995 [IT] Italy ..... MI95A1674

[51] Int. Cl.[6] ..... D04B 9/56

[52] U.S. Cl. ..... 66/148; 66/8; 66/58

[58] Field of Search ..... 66/8, 13, 48, 58, 66/148

[56] References Cited

U.S. PATENT DOCUMENTS

| | | | |
|---|---|---|---|
| 1,188,125 | 6/1916 | Williams | 66/148 X |
| 1,814,265 | 7/1931 | Schabacker | 66/148 X |
| 5,487,281 | 1/1996 | Frullini et al. | 66/8 X |
| 5,551,260 | 9/1996 | Frullini et al. | 66/58 X |
| 5,570,591 | 11/1996 | Frullini et al. | 66/148 X |

FOREIGN PATENT DOCUMENTS

| | | | |
|---|---|---|---|
| 0 592 376 | 4/1994 | European Pat. Off. . | |
| 1 346 518 | 11/1963 | France . | |
| 2 033 473 | 12/1970 | France . | |
| 676 845 | 10/1962 | Italy . | |
| 310178 | 4/1928 | United Kingdom | 66/148 |

*Primary Examiner*—John J. Calvert

*Attorney, Agent, or Firm*—Guido Modiano; Albert Josif

[57] ABSTRACT

In a first step of the method for manufacturing socks with a single-cylinder circular knitting machine a needle cylinder is oscillated about its own axis with an oscillation angle of about 180° to move half of the needle cylinder that faces a half-platen such that it passes in front of a feed of the machine. During these oscillations, engagement elements are extracted radially from the half-platen towards the needles of the machine, at least one thread dispensed at the feed, and lifting to the knitting position, at each oscillation, 1/n uniformly spaced needles of the mentioned half of the needle cylinder, varying the needles that are moved into the knitting position in the subsequent oscillation or oscillations, and lowering the needles after engaging the thread or threads, which rests on the engagement elements. A second step is then performed, during which the engagement elements are retracted towards the half-platen, retaining the thread or threads that rest thereon. During a third step, heel knitting is performed with the needles of the above-mentioned half of the needle cylinder. During a fourth step, the half-platen is overturned about the diametrical axis such that it faces the other half of the needle cylinder. In a fifth step, the threads previously retained by the engagement elements are passed to the needles of the other half of the needle cylinder. Finally, the machine is actuated for normal operation so as to complete the product.

3 Claims, 4 Drawing Sheets

METHOD FOR MANUFACTURING SOCKS HAVING A CLOSED TOE WITH A SINGLE-CYLINDER KNITTING MACHINE

BACKGROUND OF THE INVENTION

The present invention relates to a method for manufacturing socks or the like having a closed toe by means of a single-cylinder circular knitting machine.

As known, socks are generally manufactured by using circular knitting machines and, when the manufacturing steps carried out on the circular knitting machines are completed, the semi-finished socks have an open toe. It is therefore necessary to subject the resulting semi-finished products to a subsequent looping or sewing operation to close the toe and thus produce the finished product.

This further operation entails additional costs that considerably affect the overall cost of these products.

Italian Patent no. 676,845 filed Oct. 18, 1962 and granted Nov. 28, 1968 discloses a method and a device for closing socks directly on a single-cylinder circular knitting machine used for their manufacture. The device described in this patent substantially consist of a half-platen which, at the end of the manufacture of the sock, which ends at the toe, while the loops of the last row of formed knitting are held on the needles of the machine that have formed them, is placed at the upper end of the needle cylinder. The half-platen is provided with a plurality of hooks that are movable inside radial grooves that are formed in the half-platen and are orientated radially with respect to the needle cylinder. In practice, the half-platen affects half of the needle cylinder and for each needle of the machine two hooks are provided which are actuated so as to protrude from the platen, arranged on the two opposite sides of a same needle, while the needle is lowered so as to transfer its own loop to these two hooks. For each pair of hooks there is provided a pair of closure elements that can be actuated so as to close the tip of said hooks in order to firmly retain the loop received from the needles. The half-platen is then turned over, about a diametrical axis of the needle cylinder, so as to face the other half of the needle cylinder, and the hooks are actuated so as to transfer the previously received loops to the needles of the other half of the needle cylinder, which carry the last formed loop. In this manner, two loops are placed on the needles of one half of the needle cylinder and are subsequently meshed together so as to close the end of the tubular product, i.e., of the sock, which is then unloaded from the machine and requires no further treatment.

However, sock closure obtained with the method described in the above-mentioned patent is poorer in quality than the closure that can be obtained by linking or looping or sewing.

After the above-mentioned patent, other devices for closing the toe of socks directly on the single-cylinder circular knitting machine used to produce them have been proposed; however, they have the drawback of significantly penalizing the production of the single-cylinder circular knitting machines on which they are installed.

SUMMARY OF THE INVENTION

A principal aim of the present invention is to solve the above problems by providing a method that allows to produce socks, or the like, having a closed toe with a single-cylinder circular knitting machine without excessively penalizing the productive potential of the machine, so as to achieve commercially competitive products.

Within the scope of this aim, an object of the invention is to provide a method that can be performed with single-cylinder circular knitting machines and with known devices.

Another object of the invention is to provide a method that allows to close the toe of socks that can be compared aesthetically with closure obtained by linking.

This aim, these objects, and others which will become apparent hereinafter are achieved by a method for producing socks or the like having a closed toe by means of a single-cylinder circular knitting machine provided, at the upper end of the needle cylinder, with a half-platen that faces one half of the needle cylinder and is provided with thread engagement elements that can be actuated in a radial direction with respect to the needle cylinder and are adapted to engage the thread or threads fed by the machine in the region between two contiguous needles, said platen being adapted to be overturned about a diametrical axis of the needle cylinder; characterized in that it comprises: a first step, during which the needle cylinder is actuated with n oscillations about its own axis with an oscillation angle of substantially 180° to move the half of the needle cylinder that faces said half-platen so that it passes in front of a feed of the machine, said engagement elements being extracted from said half-platen radially with one of their ends, during the oscillations, towards the needles of the machine, at least one thread being dispensed at said feed, lifting to the knitting position, at each oscillation, 1/n uniformly spaced needles of said half of the needle cylinder, varying the needles that are moved into the knitting position in the subsequent oscillation or oscillations, and lowering the needles after engaging the thread or threads, which rests on said engagement elements; a second step, during which the engagement elements are retracted towards said half-platen, retaining the thread or threads that rest thereon; a third step, during which heel knitting is performed with the needles of said half of the needle cylinder; a fourth step, during which the half-platen is overturned about said diametrical axis and is made to face the other half of the needle cylinder; a fifth step, during which the thread or threads retained by said engagement elements are passed to the needles of the other half of the needle cylinder; and a sixth step, during which the machine is actuated to complete the product as a continuation of the processes performed earlier.

BRIEF DESCRIPTION OF THE DRAWINGS

Further characteristics and advantages of the invention will become apparent from the following detailed description of a preferred but not exclusive embodiment of the method according to the invention, illustrated only by way of non-limitative example in the accompanying drawings, wherein.

DESCRIPTION OF THE PREFERRED EMBODIMENTS

Figure 1:
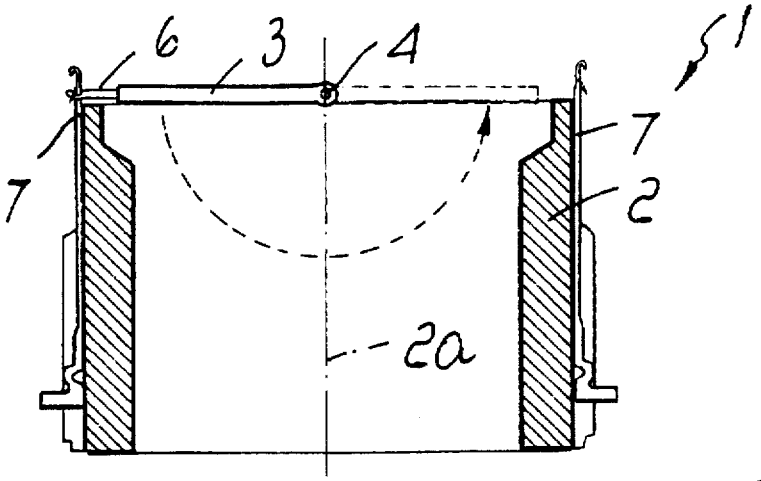
FIG. 1 is a schematic sectional view, taken along a vertical plane, of a single-cylinder circular knitting machine for manufacturing stockings equipped with a half-platen that can be overturned.
Figure 2:
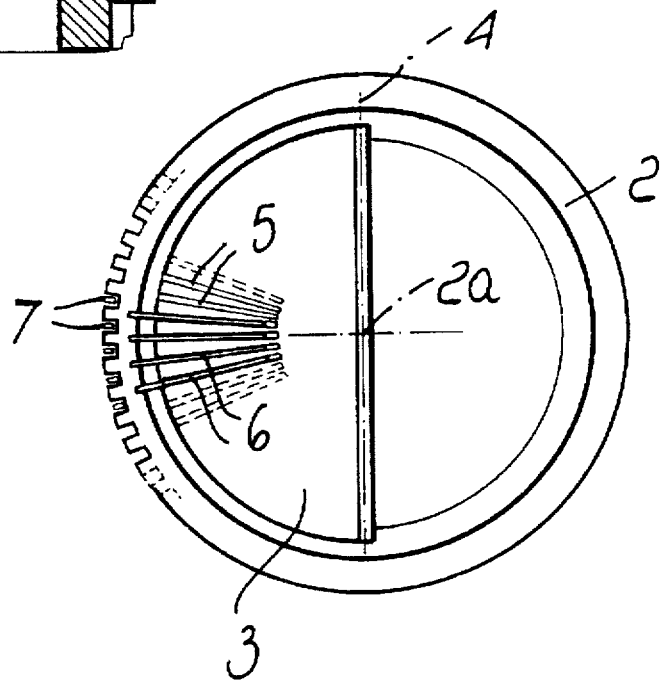
FIG. 2 is a schematic top plan view of the machine of FIG. 1.
Figure 9:
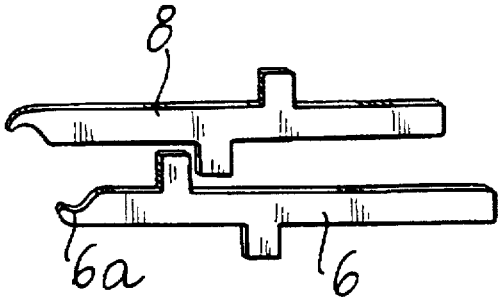
FIG. 9 is a perspective view of an engagement element, flanked by an element that cooperates with the engagement element.
Figure 10:
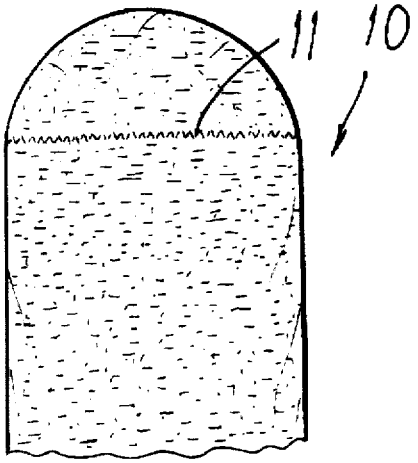
FIG. 10 is a view of the toe of a sock, manufactured with the method according to the invention.

With reference to the above figures, the method according to the invention can be performed with a single-cylinder circular knitting machine 1 that is provided, at the upper end of the needle cylinder 2, with a half-platen 3 that faces one half of the needle cylinder 2 and can be turned over, about a diametrical axis 4 of the needle cylinder, so as to face the other half of the needle cylinder.

The half-platen 3 is provided with a plurality of grooves 5 orientated radially with respect to the needle cylinder; each groove accommodates a thread engagement element 6. Said engagement element 6 can be actuated, along the corresponding groove 5, i.e., in a radial direction with respect to the needle cylinder 2, so that it can be moved between two contiguous needles 7 with its end directed towards the needle cylinder 2.

Each engagement element 6 can be constituted, for example, by a hook or by two hooks each having an end 6*a*, protruding from the half-platen 3 towards the needle cylinder 2, and shaped like a claw that is open in an upward direction. Preferably, for each hook or pair of hooks there is provided a complementary hook 8, or a pair of complementary hooks, which are movable inside said groove 5 of the half-platen 3 in which a hook 7 or a pair of hooks is accommodated. Said complementary hook 8 or pair of complementary hooks can be actuated, along the corresponding groove 5, with respect to the hook 7 so as to close and/or open the claw-shaped end 6a of the hooks.

In practice, the half-platen 3 can be constituted by a half-platen of the type described in the above-mentioned Italian patent no. 676,845.

The method according to the invention consists in producing a sock starting from its toe.

More particularly, while the half-platen 3 faces one half of the needle cylinder 2 of the machine, a first step is performed during which the needle cylinder 2 is actuated with n oscillations about its own axis 2*a* with an oscillation angle that is substantially equal to 180°. In this manner, the needle cylinder half that is faced by the half-platen 3 passes in front of a feed of the machine, at which a thread 9 or a plurality of threads, according to the requirements, is dispensed.

The term "oscillations" is used herein to refer to the actuation of the needle cylinder 2 with an alternating rotary motion about its own axis 2*a*, and an oscillation is constituted by a forward or backward stroke of the needle cylinder 2 about its own axis 2*a*.

During the oscillations, the hooks 6 are extracted radially with their claw-shaped end 6*a* from the half-platen 3 towards the needles 7 of the machine, so as to be arranged with said end 6*a* between the needles 7 of half of the needle cylinder.

During each oscillation, 1/n uniformly spaced needles 7 of the mentioned half of the needle cylinder 2 are raised into the knitting position so as to engage the thread 9 dispensed at said feed. At each successive oscillation, the needles that are raised into the knitting position are changed.

For example, if three oscillations are provided for the needle cylinder, and assuming that the needles 7 of half of the needle cylinder are divided into sets of three contiguous needles, during the first oscillation the first needles of each set of three needles are raised; during the second oscillation, the second needles of the various sets are moved to the knitting position; and during the third oscillation, the third needles of the various sets are moved into the knitting position.

After engaging the thread 9, the raised needles that are knitting are lowered so as to form the respective loops of knitting, which rest on the claw-shaped end 6*a* of the hooks 6 that is extracted from the half-platen 3.

Then, at the end of the oscillations, the number whereof is preferably between two and five, the hooks 6 are retracted towards the half-platen 3 and their claw-shaped end 6*a* is closed by the complementary hooks 8, so as to firmly retain the thread or threads 9 that rest thereon.

Figure 3:
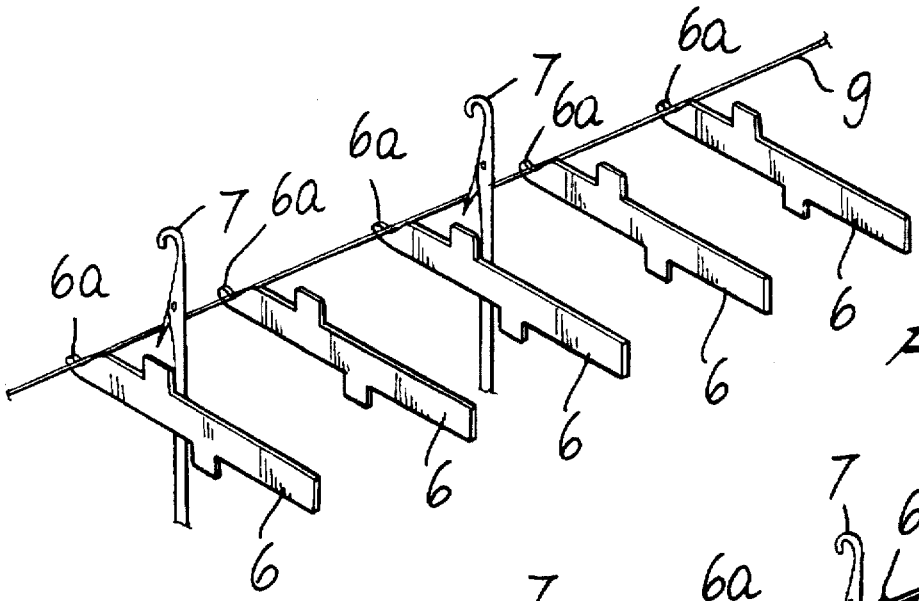
FIGS. 3 to 5 are schematic perspective views of the behavior of the needles and of the engagement elements during two successive oscillations of the needle cylinder during the execution of the first step of the method according to the invention.
Figure 4:
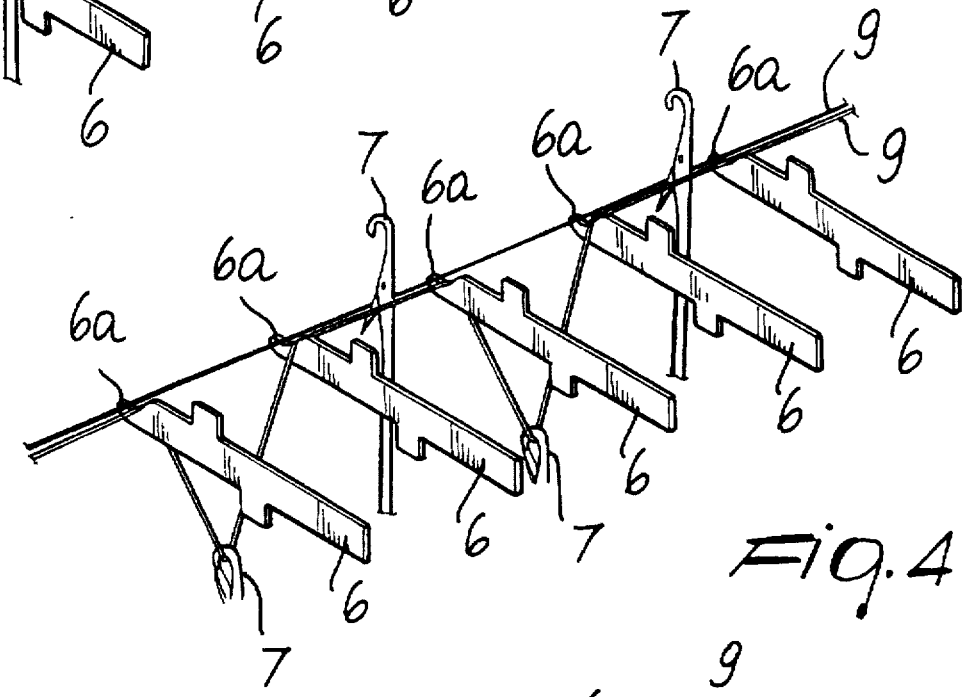
Figure 5:
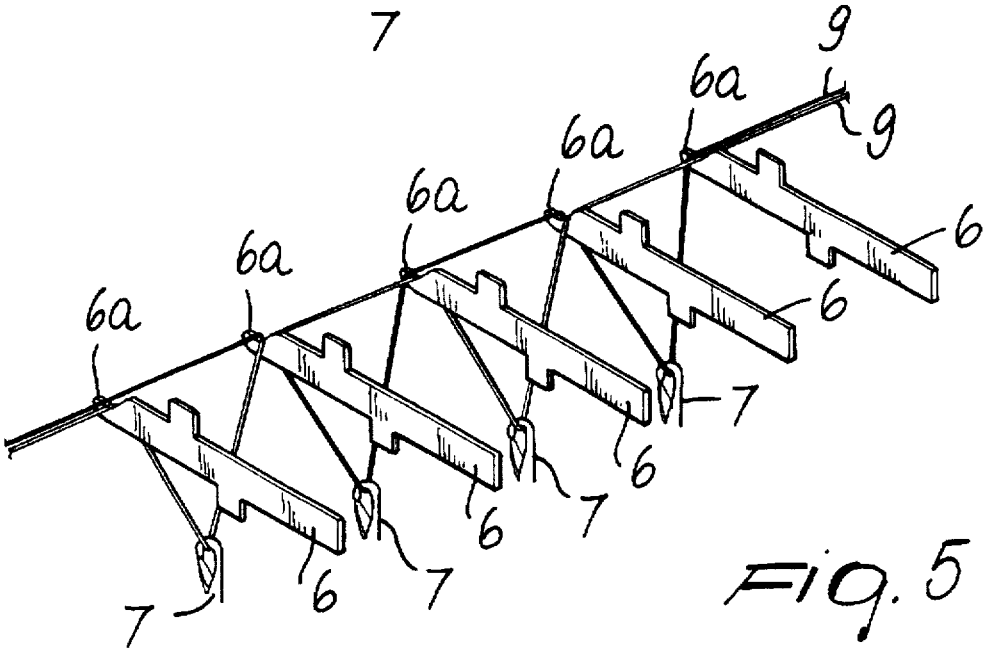

FIGS. 3 to 5 illustrate the first step of the method according to the invention, if two oscillations are performed by feeding the needles 7 always with the same thread or threads 9. In these figures, for greater clarity, the needles 7 and the hooks 6 are arranged as if the needle cylinder 2 and the platen 3 were flat instead of curved as they are in reality.

Figure 6:
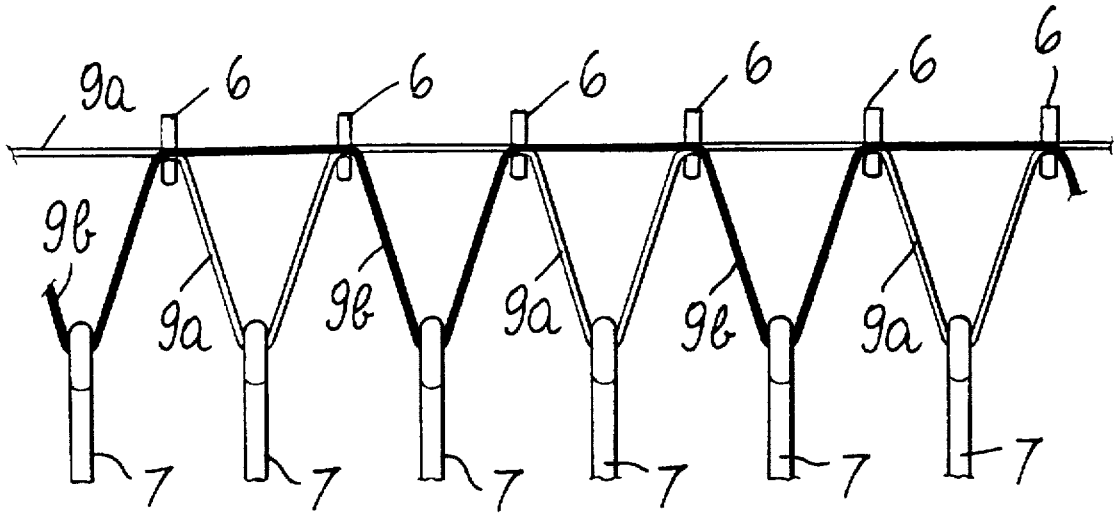
FIG. 6 is a view of the position of the threads on the needles and on the engagement elements, shown developed on a flat plane for greater clarity, after the two oscillations of the needle cylinder shown in FIGS. 3 to 5.

FIG. 6 illustrates the arrangement of the thread on the needles 7 and on the hooks 6 at the end of the two oscillations; for the sake of greater clarity, the thread fed during one of the two oscillations has been shown differently from the thread fed during the other oscillation and the two threads have been designated by the reference numerals 9*a* and 9*b*, although a same thread is preferably used.

Figure 8:
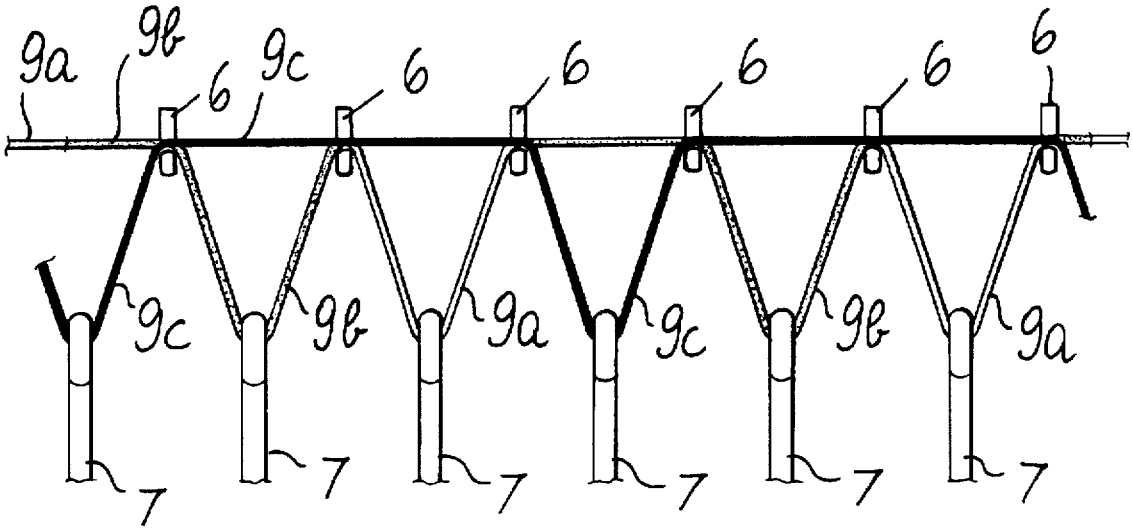
FIG. 8 is a schematic view, taken similarly to FIG. 6, assuming that three oscillations, instead of two, are performed in the first step of the method.
Figure 7:
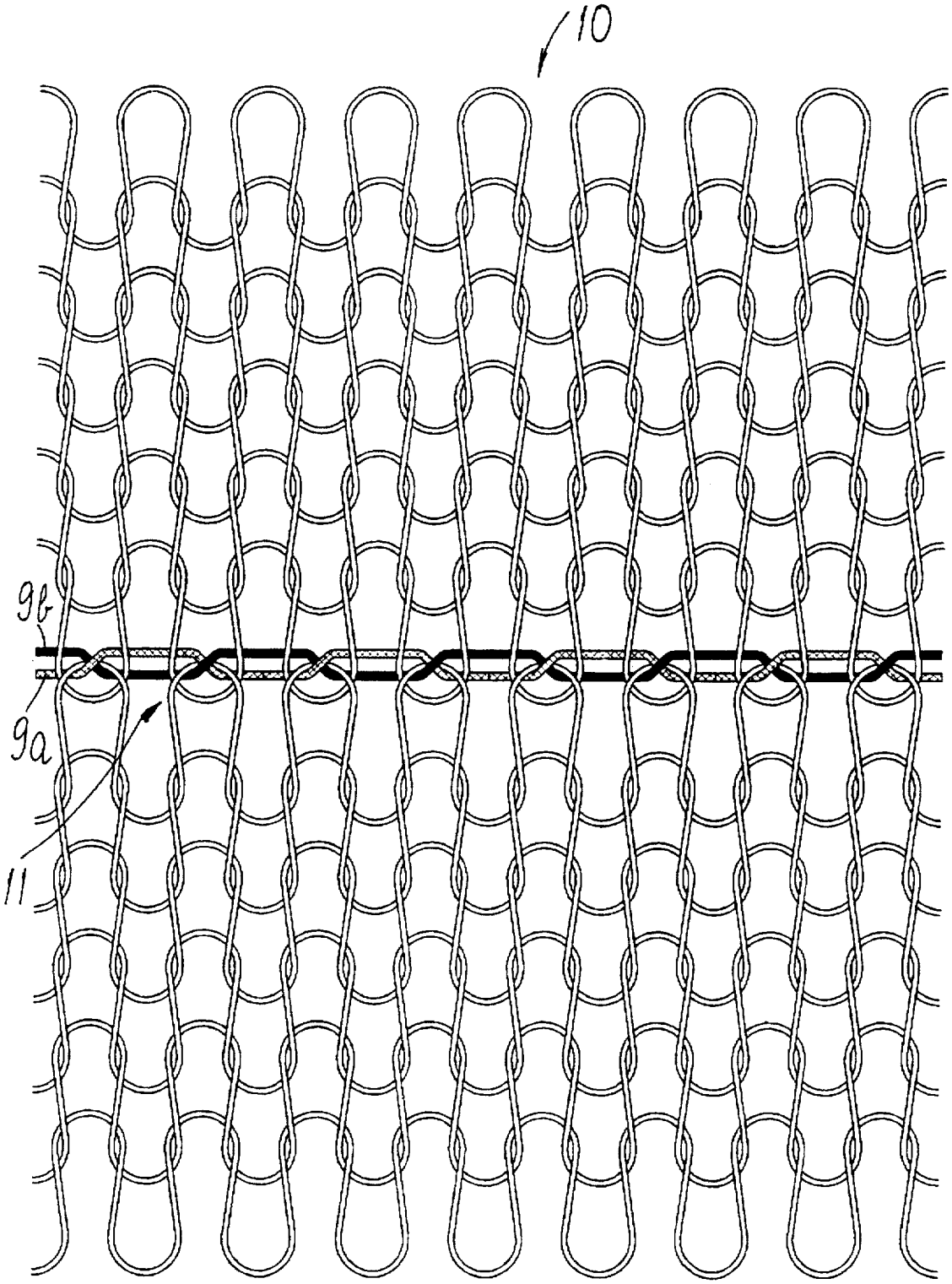
FIG. 7 is an enlarged-scale view of a portion of the sock obtained with the method according to the invention, proximate to the region produced by the oscillations of the needle cylinder during said first step of the method.

FIG. 8 illustrates the arrangement of the thread on the needles 7 and on the hooks 6 at the end of the first step, if three oscillations are performed. In this case, the threads fed during the three oscillations, although they are preferably constituted by a same thread, have been shown in different manners and designated by the reference numerals 9*a*, 9*b*, and 9*c*.

At this point, the machine is actuated so as to produce heel knitting, by using the needles 7 of the half of the needle cylinder 2 that have knitted during the oscillations performed in the first step.

Then, while the needles 7 that have produced the heel knitting retain the last formed loop, the half-platen 3 is overturned about the diametrical axis 4 and is arranged so as to face the other half of the needle cylinder 2. The hooks 6, and optionally the complementary hooks 8, are then actuated in a per se known manner so as to pass the thread or threads 9 retained by the hooks to the needles 7 of the other half of the needle cylinder 2.

Finally, knitting continues in a per se known manner, until the product is completed; the product is then unloaded from the machine in a per se known manner.

The product 10 obtained with the method according to the invention therefore has a closed toe at the region 11 knitted with the oscillations of the needle cylinder during the first step of the method and does not have to be subjected to further treatment or finishing operations before being marketed.

As an alternative, instead of using a half-platen 3 that is arranged inside the needle cylinder 2, as shown, it is possible to use an annular half-platen that faces the outside of the needle cylinder 2.

In practice, it has been observed that the method according to the invention fully achieves the intended aim, since it allows to produce socks or the like having a closed toe by means of a single-cylinder circular knitting machine without significantly penalizing the productive potential of the circular machine, in any case allowing to produce commercially competitive products.

The method thus conceived is susceptible of numerous modifications and variations, all of which are within the scope of the inventive concept; all the details may furthermore be replaced with other technically equivalent elements.

What is claimed is:

1. Method for producing hosiery having a closed toe on a single-cylinder circular knitting machine provided, at the upper end of a needle cylinder having a central axis, with a half-platen that faces one half of the needle cylinder and is provided with thread engagement elements having opposite ends for actuation in a radial direction with respect to the needle cylinder and for engagement with the thread or threads fed by the machine in the region between two contiguous needles, said half-platen being rotatable about a diametrical axis of the needle cylinder; the method comprising: a first step, actuating the needle cylinder with n oscillations about the cylinder axis with an oscillation angle of substantially 180° to move the half of the needle cylinder that faces said half-platen so that the half needle cylinder passes in front of a feed of the machine, extracting, during oscillation said thread engagement elements from said half-platen radially with one of the ends towards the needles of the machine, feeding at least one thread at said feed and lifting in each oscillation 1/n uniformly spaced needles of said half of the needle cylinder to a knitting position, varying the needles that are lifted into the knitting position in the subsequent oscillation or oscillations, and lowering the needles after engaging the thread or threads, which rests on said engagement elements; a second step, retracting the engagement elements towards said half-platen, retaining the thread or threads that rest thereon; a third step, knitting a heel with the needles of said half of the needle cylinder; a fourth step, rotating the half-platen about said diametrical axis so as to face the other half of the needle cylinder; a fifth step, passing the thread or threads retained by said engagement elements to the needles of the other half of the needle cylinder; and a sixth step, continuing knitting the hosiery product as a continuation of the processes performed previously.

2. Method according to claim 1, wherein the first step includes setting the number of the oscillations between two and five.

3. Method according to claim 1, further comprising always feeding the same thread or threads fed during the oscillations of the needle cylinder during said first step.

* * * * *